US008245965B2

(12) United States Patent
Andrea et al.

(10) Patent No.: US 8,245,965 B2
(45) Date of Patent: Aug. 21, 2012

(54) PARALLEL CONDUCTOR SPOOL WITH MULTIPLE INDEPENDENT BAYS

(75) Inventors: Timothy M. Andrea, Douglasville, GA (US); Mark Dixon, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 346 days.

(21) Appl. No.: 12/604,883

(22) Filed: Oct. 23, 2009

(65) Prior Publication Data

US 2011/0095124 A1 Apr. 28, 2011

(51) Int. Cl.
*B65H 75/38* (2006.01)

(52) U.S. Cl. ..... 242/388.6; 242/404.2; 242/474.8; 242/594.3; 242/603; 242/614; 242/118.41

(58) Field of Classification Search ..... 242/388, 242/388.6, 388.7, 388.8, 396, 396.1, 398, 242/404, 404.2, 406, 472.8, 474.3, 474.8, 242/594, 594.2, 594.3, 598, 598.5, 603, 611, 242/614, 118.41, 129.6, 378.4
See application file for complete search history.

(56) References Cited

U.S. PATENT DOCUMENTS

| | | | | |
|---|---|---|---|---|
| 6,193,185 | B1 * | 2/2001 | Kim | 242/473.5 |
| 6,435,450 | B1 * | 8/2002 | Shields et al. | 242/594.3 |
| 2008/0048063 | A1 * | 2/2008 | Wells et al. | 242/557 |

* cited by examiner

*Primary Examiner* — William E Dondero
(74) *Attorney, Agent, or Firm* — Hope Baldauff Hartman, LLC

(57) ABSTRACT

A parallel conductor spool can support multiple independently rotating bays. The parallel conductor spool may be used to hold and pay-out materials. The parallel conductor spool can support independent rotation of the bays at differing rates to provide for paying-out conductors of varying sizes at different speeds. The parallel conductor spool may be modular and expandable to support various configurations. The parallel conductor spool may be formed of disposable or recyclable materials to reduce the cost and logistical complexity of returning the spool. The bays within the parallel conductor spool can be configured to accommodate changes in product size, type, lengths, and the number of items on, or bays within, the spool.

20 Claims, 5 Drawing Sheets

PARALLEL CONDUCTOR SPOOL WITH MULTIPLE INDEPENDENT BAYS

BACKGROUND

During installation, wires, conductors, or cables may be dispensed from the spools upon which they are provided to the installer. The spools may be mounted on an axle to support rotation of the spools during the dispensing process. For example, a 48 inch heavy wooden reel may be used to transport and provide conductors to an installation site.

Often, more than one conductor or wire may be installed simultaneously. The simultaneous installation of multiple conductors may be referred to as paralleling. Paralleling may be achieved by providing multiple conductors on a spool or reel. However, when paralleling conductors of differing sizes, the conductors may be dispensed at varying rates leading to the accumulation of slack in one or more of the conductors as they are dispensed. Furthermore, mechanical interference between the conductors may be caused by accumulated slack or other interactions between the conductors as they are dispensed. Such accumulated slack, mechanical interference, or other interactions may result in entanglement or damage of the conductors during installation. These installation complications may result in wasted materials or wasted labor time leading to higher costs and delays.

Larger spools and reels used for wires and conductors are often returnable to vendors or manufactures for reuse. Returnable materials, such as these, often result in losses, additional costs, and various logistical complications.

SUMMARY

It should be appreciated that this Summary is provided to introduce a selection of concepts in a simplified form that are further described below in the Detailed Description. This Summary is not intended for use in limiting the scope of the claimed subject matter.

Apparatus, systems, and methods are described herein for parallel conductor spools having multiple independently rotating bays. The parallel conductor spool may also be referred to as a multi-bay reel. The parallel conductor spool is used to hold and pay-out, or dispense, materials. The parallel conductor spool can support independent rotation of the bays at differing rates to provide for paying-out conductors of varying sizes at different speeds. The parallel conductor spool may be modular and expandable to support various configurations. The parallel conductor spool may be formed of disposable or recyclable materials to reduce the cost and logistical complexity of returning the spool. The bays within the parallel conductor spool can be configured to accommodate changes in product size, type, lengths, and the number of items on, or bays within, the spool.

According to at least one embodiment, a spooling system includes a reel. The reel comprises two fixed end flanges, two or more independently rotatable bays disposed along a common axis of rotation between the two fixed end flanges, and a rotation lock for temporarily fixing the rotation of the bays to the two fixed end flanges.

According to further embodiments, a method for spooling provides a parallel conductor spool having multiple independently rotating bays. The bays can be temporarily locked to prevent independent rotation. The parallel conductor spool rotates to take-up conductors onto one or more of the bays.

According to further embodiments, a parallel conductor spool is configured to provide multiple independently rotating bays. The spool can be configured to support modularity of the bays. Furthermore, the spool is configured to pay-out multiple conductors from the bays in parallel. Also, the spool is configured to support the pay-out of the multiple conductors at differing rates.

Other apparatus, systems, and methods according to embodiments will be or become apparent to one with skill in the art upon review of the following drawings and Detailed Description. It is intended that all such additional methods, apparatus, and/or systems be included within this description, be within the scope of the present invention, and be protected by the accompanying claims.

DETAILED DESCRIPTION

The following detailed description is directed to parallel conductor spools having multiple independently rotating bays for parallel pay-out of multiple conductors with reduced tangling, damage, or slack accumulation. In the following detailed description, references are made to the accompanying drawings that form a part hereof, and which are shown by way of illustration, specific embodiments, or examples.

Figure 1:
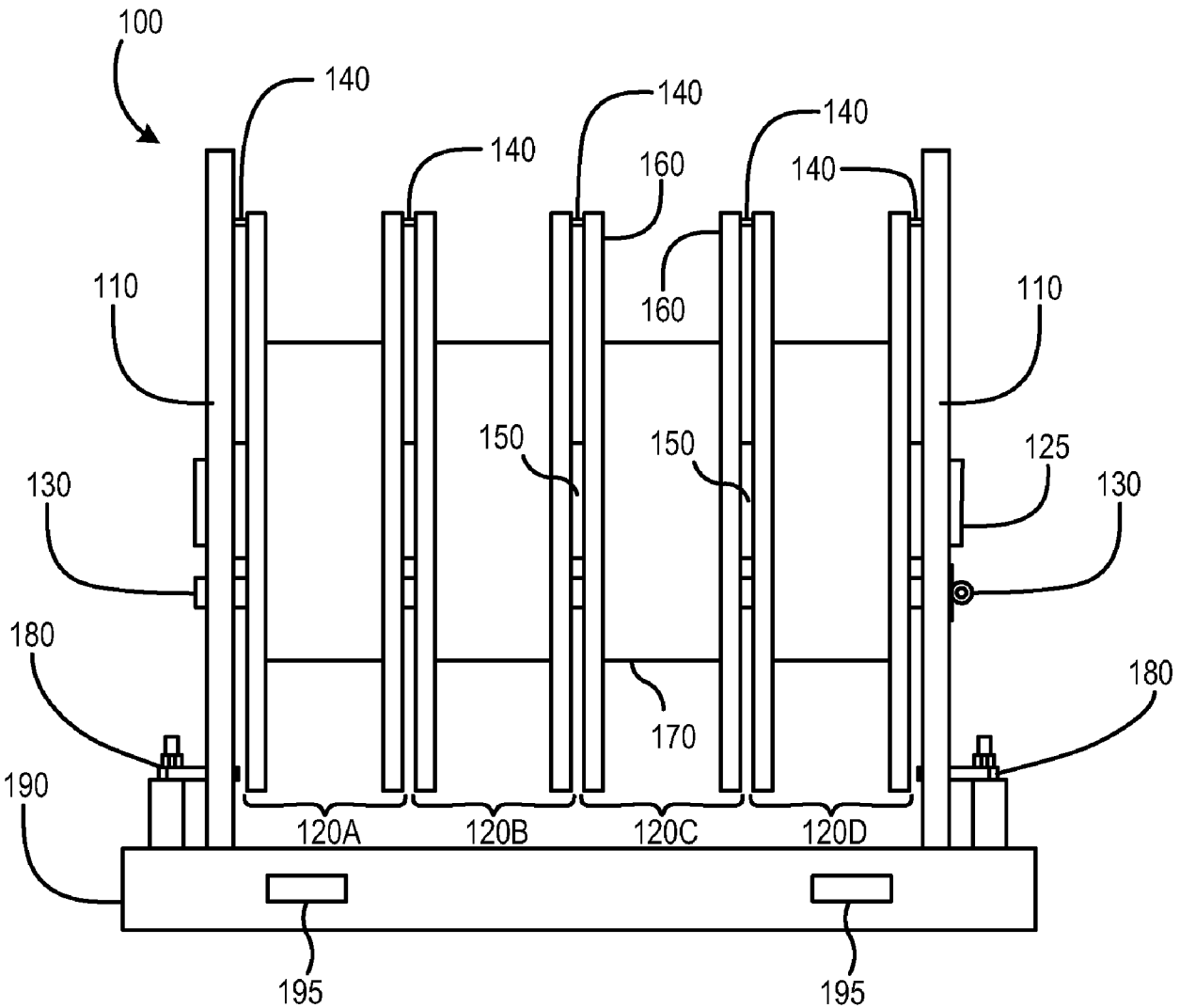
FIG. 1 is an elevation view showing details of a parallel conductor spool having multiple independent bays, according to various embodiments presented herein.

Referring now to the drawings, in which like numerals represent like elements through the several figures, aspects of a parallel conductor spool having multiple independently rotating bays will be described. FIG. 1 illustrates an elevation view of a parallel conductor spool 100 having multiple independent bays 120A-120D according to one or more embodiments presented herein. The multiple independent bays 120A-120D may be referred to generically or collectively as bays 120. The bays 120 may operate as individual or smaller reels or spools within the larger parallel conductor spool 100. The parallel conductor spool 100 may be made up of two outer flanges 110 and a central hub 125. The outer flanges 110 may remain fixed or stationary while the bays 120 independently rotate around the central hub 125. Independent rotation of each of the respective bays 120 can support pay-out of conductors from each bay 120 at varying rates. Pay-out of conductors at differing rates may prevent tangles, slack, or damage from occurring during installation of the parallel conductors at a jobsite.

The parallel conductor spool 100 is modular and may be expanded or variably configured by adding or removing bays 120. The bays 120 may be of varying sizes and may support conductors of various dimensions and configurations. According to one embodiment, four bays 120A-120D may be configured to dispense a parallel set of conductors for alternating current or direct current power of any voltage range.

Three of the bays 120A-120C may support insulated conductors, while a fourth bay 120D may support a ground wire or other conductor of a smaller or larger size. The fourth bay 120D may pay-out at a different rate due to the difference in conductor diameter. The independently rotating bays 120 of the parallel conductor spool 100 support this variable rate pay-out of the conductors.

The parallel conductor spool 100 may be constructed such that the outer flanges 110 form a dimension similar to a traditional 48 inch heavy wood reel. Alternatively, the parallel conductor spool 100 may be of varying dimensions according to various other embodiments. The bays 120 may be made of disposable material such as wood, plastic, cardboard, or metal. According to one embodiment, one of the bays 120 is constructed of a steel hub 170 and two flanges 160. The flanges 160 may be made of wood, cardboard, plastic, metal, any other material, or any combination thereof.

A spacer 150 may be provided between each neighboring pair of the bays 120. The spacer 150 may also be positioned between the outer flanges 110 of the parallel conductor spool 100 and the bays 120 adjacent to the flanges. According to some embodiments, the spacer 150 is formed as a ring or washer for positioning over the central hub 125 between the bays 120. According to some other embodiments, the spacer 150 is formed onto each of the bays 120 as part of the hub 170 or the flange 160 of the respective bay. The spacers 150 may serve to mechanically isolate each of the bays 120 from its neighboring bay or outer flange 110. Further, the spacers 150 may serve to prevent friction, catching, or interference between the outer surfaces of the flanges 160 of neighboring bays 120. As such, the spacers 150 may aid in the independent rotation of the bays 120 within the parallel conductor spool 100.

A locking rod 130 may be inserted through the outer flanges 110 and voids or holes within the bays 120 such that the bays are locked stationary within the parallel conductor spool 100. Insertion of the locking rod 130 temporarily prevents the independent rotation of the bays 120. Such locking may support take-up of conductors onto the bays 120 by rotating the parallel conductor spool 100 with the bays 120 locked into place. The locking rod 130 may also be used during shipping of the parallel conductor spool 100 to temporarily prevent the independent rotation of the bays 120.

According to exemplary embodiments, shipping clips 140 are applied to the flanges 160 of the bays 120 and to the outer flanges 110 of the parallel conductor spool 100, as discussed further below in view of FIG. 2. The shipping clips 140 temporarily prevent rotation of the bays 120 within the parallel conductor spool 100 during shipping, transport, or manufacture. The shipping clips 140 may be removed from the parallel conductor spool 100 to allow independent rotation of the bays 120 during pay-out of conductors spooled onto the bays 120.

Either the locking rod 130 or the shipping clips 140 may be used to restrict rotation of the bays 120 within the outer flanges 110 of the parallel conductor spool 100. According to some embodiments, the locking rod 130 may be stronger to support locking of the bays 120 while the parallel conductor spool 100 is rotated for the purpose of taking-up conductors during a manufacturing or assembly process. In contrast, the shipping clips 140 may be lightweight, disposable elements for affixing the bays 120 during storage or transit.

The parallel conductor spool 100 may be supported by a pallet platform 190. According to exemplary embodiments, the parallel conductor spool 100 is affixed to the pallet platform 190 using reel clamps 180. Rotation of the parallel conductor spool 100 may be restricted by fixing the outer flanges 110 of the parallel conductor spool to the pallet platform 190 using the reel clamps 180, a chock, or slots 230 within the pallet platform 190, as discussed further below in view of FIG. 2. The outer flanges 110 of the parallel conductor spool 100 may be held into the slots 230 within the pallet platform 190 by gravity, friction, or compression. Forklift provisions 195 may be provided within the pallet platform 190 to allow a forklift or pallet jack to lift and maneuver the pallet platform along with the attached parallel conductor spool 100.

The bays 120, given their modular nature, may be loaded or spooled separately and then assembled onto the parallel conductor spool 100. The bays 120 may also be locked within the parallel conductor spool 100 using the locking rod 130. Locking of the bays 120 allows loading of the bays 120 by rotating the entire parallel conductor spool 100 similar to rotating a traditional 48 inch heavy wood reel for take-up or spooling of conductors. Take-up of conductors, wires, or cables may also be performed sequentially on separate bays 120. For example, a first bay, such as the bay 120A, may be spooled with a first conductor to completion and then the rotation of the parallel conductor spool 100 may be continued while a second conductor is spooled onto a second bay, such as the bay 120B.

While the parallel conductor spool 100 is used for the spooling of wire or cable as discussed herein, the parallel conductor spool 100 may also be used for tubing, hoses, or any other elements that may be rolled onto the bays 120 for parallel pay-out. Such parallel pay-out can support transportation and installation of the individual conductors, tubes, or other rolled elements together.

According to exemplary embodiments, the parallel conductor spool 100 and the bays 120 within the parallel conductor spool are constructed of low-cost, disposable materials such as wood, cardboard, or metals. Such low-cost construction supports field disposal or material recycling of the parallel conductor spool 100. Field disposal of the parallel conductor spool 100 or other recycling options may reduce expense and logistical complications associated with returning spools or spooling assemblies to vendors or manufacturers. The pallet platform 190 may be constructed of wood, metal, or any other rigid material. The pallet platform 190 may be reusable, recyclable, or disposable.

Figure 2:
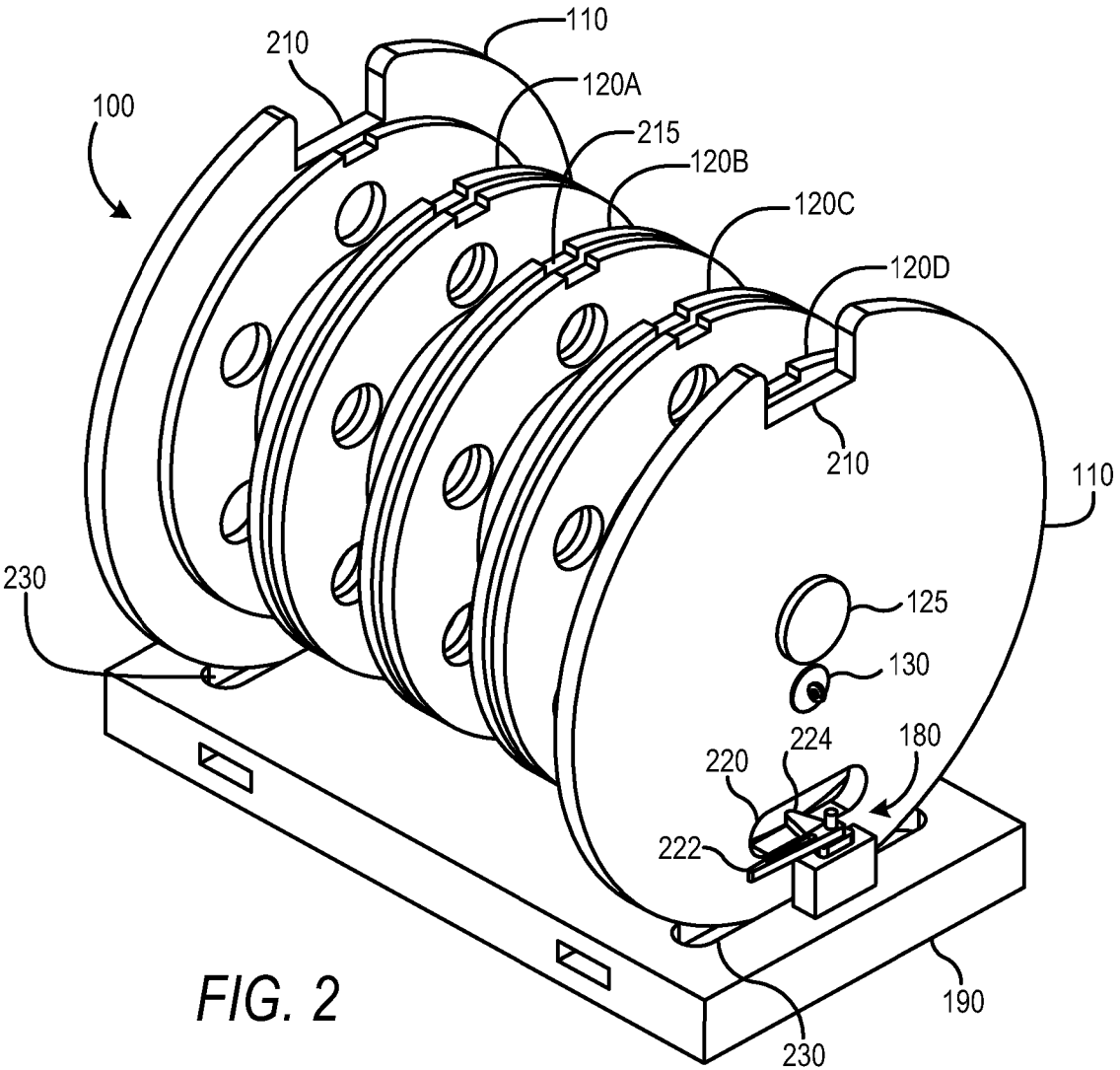
FIG. 2 is a perspective view showing details of a parallel conductor spool upon a pallet platform, according to various embodiments presented herein.

Turning now to FIG. 2, further details of the parallel conductor spool 100 having multiple independently rotating bays 120, according to various embodiments presented herein, will be described. FIG. 2 is a perspective view illustrating the parallel conductor spool 100 upon the pallet platform 190 according to one or more embodiments presented herein. As discussed above, the parallel conductor spool 100 may be affixed to the pallet platform 190 by one or more of the reel clamps 180. The parallel conductor spool 100 may also be held stationary upon the pallet platform 190 using a chock, other clamping, or other locking mechanisms.

In addition to affixing the parallel conductor spool 100 to the pallet platform 190 via one or more of the reel clamps 180, the outer flanges 110 of the parallel conductor spool 100 may be placed into slots 230 within the pallet platform to support locking and transporting of the parallel conductor spool upon the pallet platform. According to exemplary embodiments, the reel clamp 180 provides a locking element 224 that may be rotated using a lock handle 222. When rotated, the locking element 224 can engage into a void 220 provided within one or more of the outer flanges 110 of the parallel conductor spool 100.

As discussed with respect to FIG. 1, the shipping clips 140 may be attached to the bays 120 and the outer flanges 110 of the parallel conductor spool 100 for further prevention of rotation of the bays within the parallel conductor spool during shipping, transport, or manufacture. According to exemplary embodiments, notches 215 within the flanges 160 of the bays 120 are provided for attaching the shipping clips 140. Similarly, end flange notches 210 within the end flanges 110 may also support the shipping clips 140. The shipping clips 140 may be blocks, rods, staples, wires, clamps or any other elements used to fix the rotation of the bays 120 within the parallel conductor spool 100. Alternatively, a bar may be placed between the end flange notches 210 across the bays 120 to engage the bay notches 215 and restrict the individual rotation of the bays 120 within the parallel conductor spool 100. Furthermore, as discussed with respect to FIG. 1, the locking rod 130 may be used to restrict rotation of the bays 120 within the parallel conductor spool 100.

Figure 3:
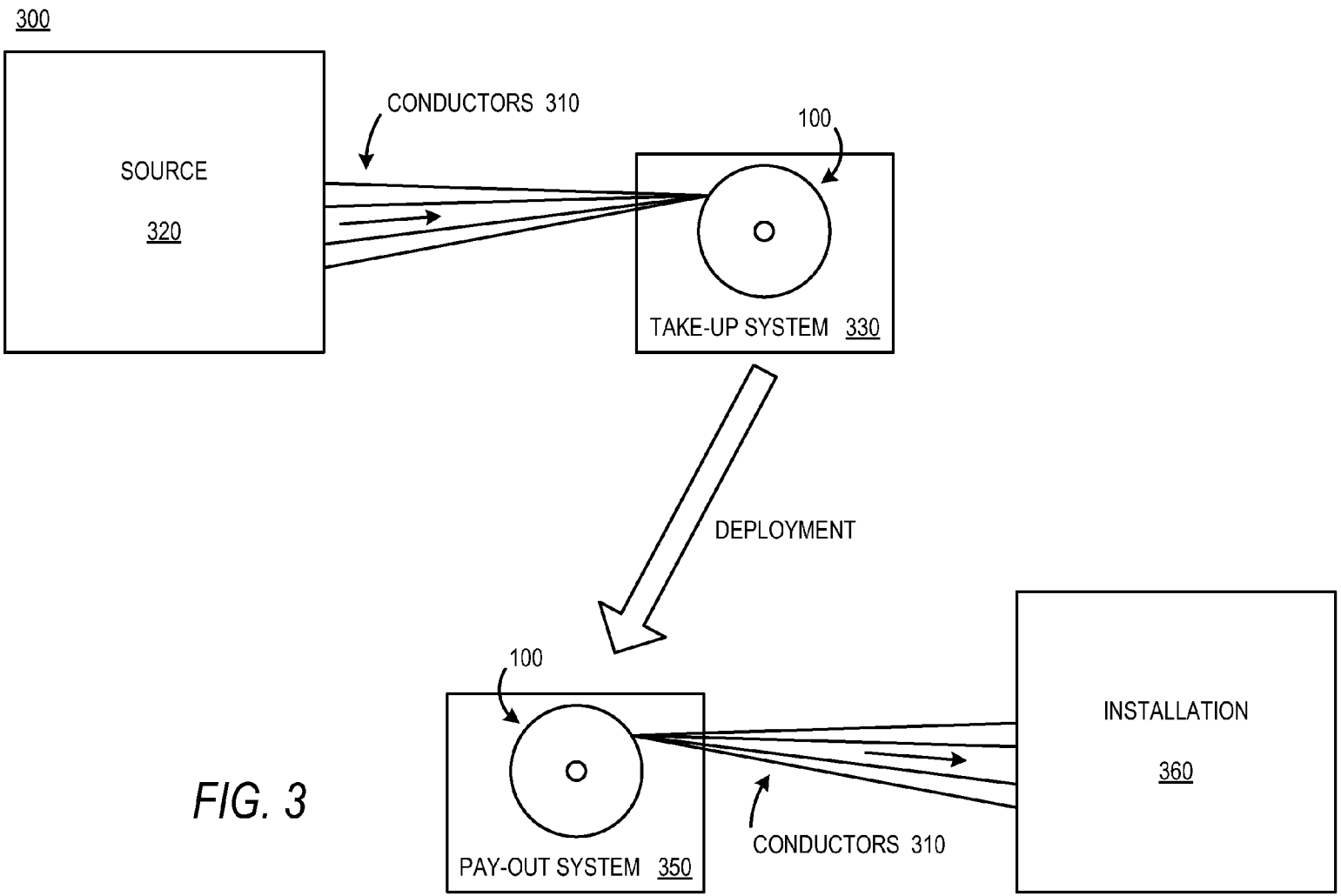
FIG. 3 is a context diagram showing details of take-up and pay-out of parallel conductors from a parallel conductor spool, according to various embodiments presented herein.

Turning now to FIG. 3, further details of the parallel conductor spool 100 having the multiple independently rotating bays 120, according to various embodiments presented herein, will be described. FIG. 3 is a context diagram 300 illustrating take-up and pay-out of parallel conductors 310 from the parallel conductor spool 100, according to one or more embodiments presented herein. A source 320 of the conductors 310 may be a manufacturing facility or storage facility of the conductors 310. The parallel conductor spool 100 may be mounted within a take-up system 330. The take-up system 330 may rotate the parallel conductor spool 100. The conductors 310 may be taken up upon the parallel conductor spool 100 mounted within the take-up system 330 as the parallel conductor spool 100 is rotated. A rotating element within the take-up system 330 may engage the parallel conductor spool 100 at the central hub 125; or at one, or both, of the outer flanges 110. The rotating element within the take-up system 330 may be driven by an electric motor or any other mechanism for driving rotations of the parallel conductor spool 100 within the take-up system 330.

As discussed further below in view of FIG. 4, the conductors 310 may be taken-up from the source 320 all at the same rate or at individually varying rates, according to embodiments. The conductors 310 may be taken-up from the source 320 in parallel, in separate sequential stages, or as separate operations according to various embodiments or applications.

When the conductors 310 are taken-up from the source 320 separately onto the individual bays 120, the parallel conductor spool 100 may then be assembled to include the bays 120 that have been independently loaded with conductor in a separate initial operation.

The parallel conductor spool 100, once loaded with the conductors 310, may be removed from the take-up system 330 and deployed to the field. Once deployed, the parallel conductor spool 100 may be supported within a pay-out system 350. The pay-out system 350 may include a pallet platform, such as the pallet platform 190; a reel support structure; or other conductor reel mechanism. The conductors 310 may be paid-out from the parallel conductor spool 100 into an installation 360. The installation 360 may be a building, cabinet, closet, vehicle, or any other location or object where the parallel conductors 310 are being installed. The independent rotation of the bays 120 can support paying-out the conductors at differing rates. Paying-out conductors at varying rates can be advantageous when conductors having different sizes are involved. The parallel pay-out of conductors is discussed in additional detail with respect to FIG. 5.

According to various embodiments, the parallel conductors 310 may be used for power delivery such as alternating current or direct current electricity. The conductors 310 may also be used for DC or low voltage applications. The conductors 310 may also be used for communication applications such a coaxial cable, video, fiber optics, data networks, telephones, grounding systems, control systems, automation systems, water tubing, heater tubing, or any other application where wires, cables, conductors, or other rolled elements may be used.

Figure 4:
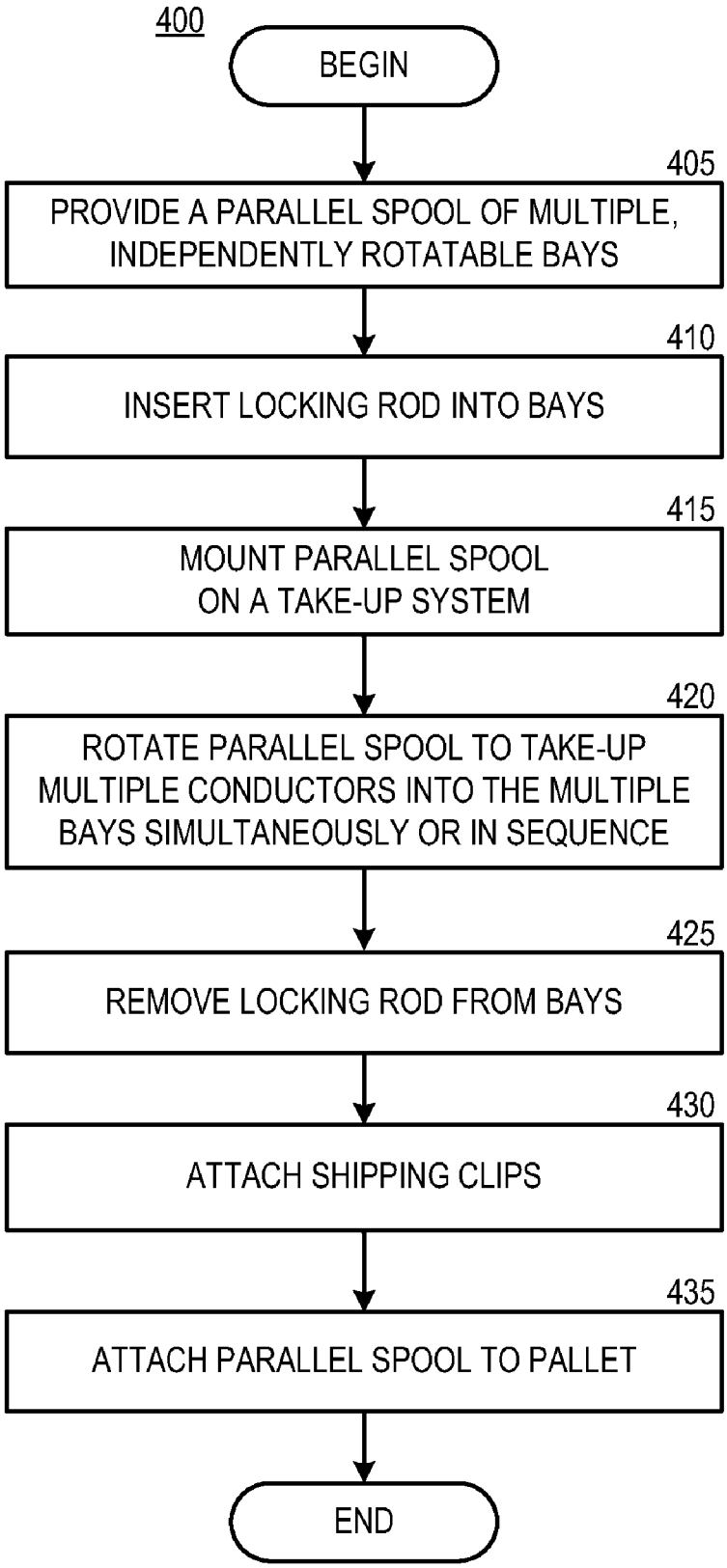
FIG. 4 is a flow diagram illustrating a process for take-up of conductors onto a parallel conductor spool having multiple independently rotating bays, according to various embodiments presented herein.

Turning now to FIG. 4, additional details will be provided regarding the embodiments presented herein for the parallel conductor spools 100 having the multiple independently rotating bays 120. In particular, FIG. 4 is a flow diagram illustrating a process 400 for take-up onto the parallel conductor spool 100 having the multiple independently rotating bays 120 according to at least some embodiments presented herein.

It should be appreciated that the operations described herein are implemented as a sequence of operational or manufacturing acts, as a sequence of computer implemented acts or program modules running on a computing system, or as interconnected machine logic circuits or circuit modules within the computing system. The implementation is a matter of choice dependent on the performance and other requirements of the various embodiments. Some of the logical operations described herein are referred to variously as state operations, structural devices, acts, or modules. It should also be appreciated that more or fewer operations may be performed than shown in the figures and described herein. These operations may also be performed sequentially, in parallel, or in a different order than those described herein.

The process 400 begins at operation 405 where a parallel reel or the parallel conductor spool 100 is provided having the multiple independently rotating bays 120. At operation 410, the locking rod 130 is inserted into the parallel conductor spool 100 through the bays 120 to prevent rotation of the bays within the parallel conductor spool 100. The shipping clips 140 may also be used to prevent rotation of the bays 120 instead of, or in addition to, the locking rod 130.

Continuing to operation 415, the parallel conductor spool 100 is mounted within the take-up system 330. At operation 420, the take-up system 330 may rotate the parallel conductor spool 100 such that conductors may be taken-up into each of the respective multiple bays 120 at the same time or in sequence.

According to an exemplary embodiment where the conductors are taken-up into the bays 120 in sequence, a first conductor is taken-up into the independent bay 120A during rotation of the parallel conductor spool 100. Once the independent bay 120A is completely spooled with the first conductor, the parallel conductor spool is rotated such that a second conductor is then taken-up into the independent bay 120B. This process continues until the conductors are taken-up into all, or a portion of, the independent bays 120A-120D.

According to an exemplary embodiment where the conductors are taken-up into the bays 120 simultaneously, conductors are taken-up into two or more of the bays 120 in parallel. For example, during rotation of the parallel conductor spool 100, a first conductor is taken-up into the independent bay 120A while a second conductor is simultaneously taken-up into the independent bay 120B.

According to further embodiments, before the independent bays 120A-120D are assembled together into or onto the parallel conductor spool 100, a conductor is taken-up into each of the independent bays. The separately spooled bays 120 are then assembled into or onto the parallel conductor spool 100.

At operation 425, the locking rod 130 is removed from the bays 120 and the parallel conductor spool 100. Alternatively, the locking rod 130 may remain within the parallel conductor spool 100 to lock the parallel conductor spool 100 during shipping.

At operation 430, the shipping clips 140 are applied to the parallel conductor spool 100. The shipping clips 140 are applied to the bay notches 215 that are disposed within the flanges 160 of the bays 120. The shipping clips 140 may also interface to the end flange notches 210 within the end flanges 110 of the parallel conductor spool 100. The shipping clips 140 may be applied when the locking rod 130 has been removed or even if the locking rod 130 remains within the parallel conductor spool 100.

At operation 435, the parallel conductor spool 100 is placed upon the pallet platform 190. The parallel conductor spool 100 may be placed within the slots 230 disposed within the pallet platform 190. The parallel conductor spool 100 may be affixed to the pallet platform 190 for storage or transport. The parallel conductor spool 100 may be fixed against rotation onto the pallet platform 190 using one or more reel clamps, such as the reel clamps 180. According to exemplary embodiments, the reel clamps 180 lock into the voids 220 disposed within the parallel conductor spool 100. The parallel conductor spool 100 may also be fixed against rotation using a chock or any other locking or breaking mechanism.

Figure 5:
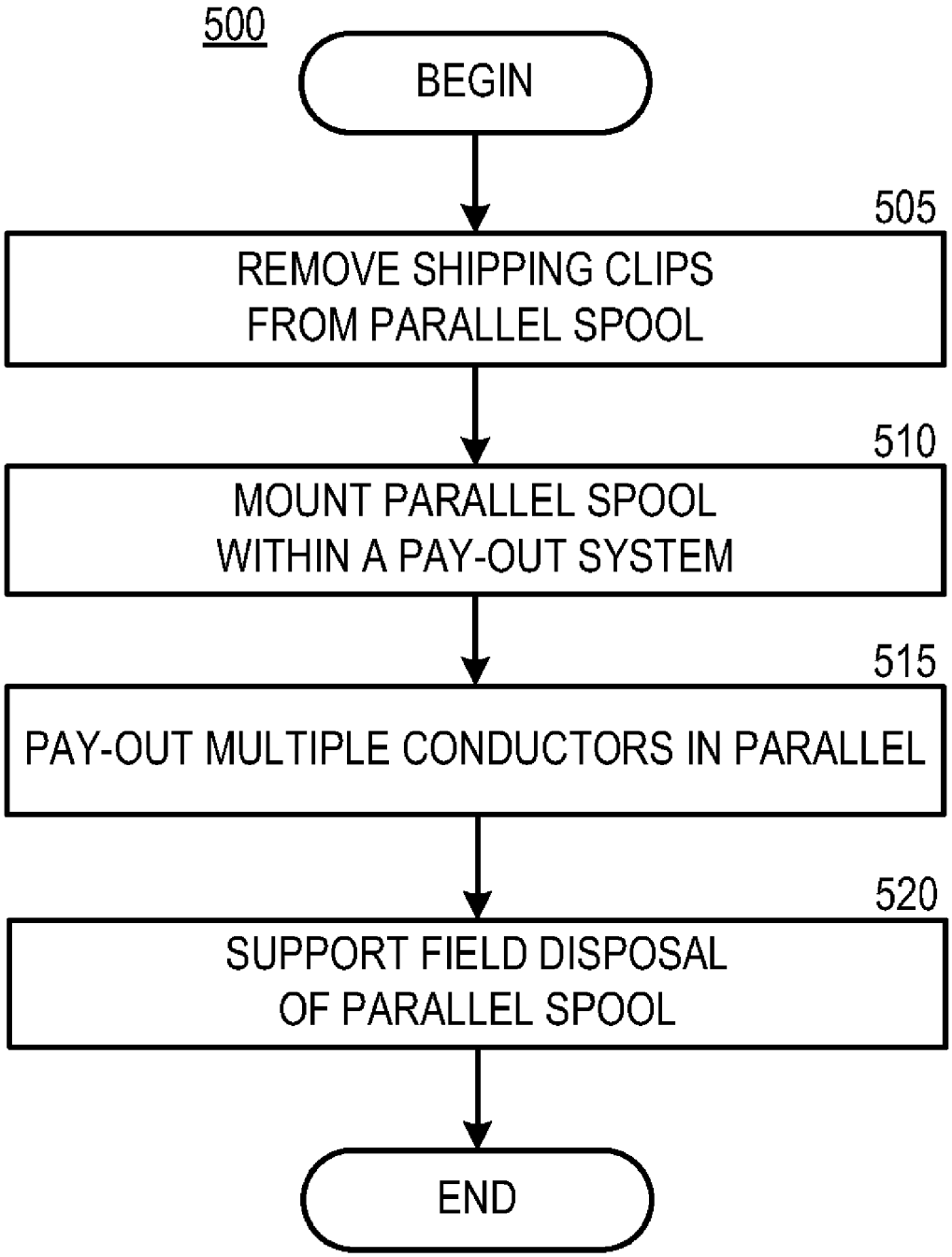
FIG. 5 is a flow diagram illustrating a process for pay-out of conductors from a parallel conductor spool having multiple independently rotating bays, according to various embodiments presented herein.

Turning now to FIG. 5, additional details will be provided regarding the embodiments presented herein for the parallel conductor spools 100 having the multiple independently rotating bays 120. In particular, FIG. 5 is a flow diagram illustrating a process 500 for pay-out of conductors from the parallel conductor spool 100 having the multiple independently rotating bays 120 according to at least some embodiments presented herein. The process 500 may begin at operation 505 where the shipping clips 140 and the locking rod 130, if inserted, are removed from the parallel conductor spool 100.

Continuing to operation 510, the parallel conductor spool 100 is mounted within the pay-out system 350. The pay-out system 350 may include the pallet platform 190 or other mechanism for supporting the parallel conductor spool 100 during pay-out of the conductors 210.

At operation 515, the multiple conductors 310 can be paid-out in parallel. Paying-out the conductors 310 in parallel can support efficient installation of the conductors at a jobsite or assembly facility where the conductors 310 are being installed.

The parallel pay-out of the conductors 310 may be supported by varying rates of rotation of the independent bays 120. Allowing the individual bays 120 to rotate at varying rates can support the parallel pay-out of differently sized conductors without accumulation of slack, tangles, or other complications.

Moreover, parallel pay-out of the conductors 310 from the independently rotating bays 120 can support reduced tangling of the conductors 310. Supporting varying rates of rotation among the bays 120 can support the parallel pay-out of conductors with significantly reduced tangling.

Further, parallel pay-out of the conductors 310 from the independently rotating bays 120 can support reduced accumulation of slack in one or more of the conductors 310. Supporting varying rates of rotation among the bays 120 can support the parallel pay-out of conductors with significantly reduced slack accumulation.

Parallel pay-out of the conductors 310 from the independently rotating bays 120 can also support reduced damage to the conductors 310. The independent rotation of bays 120 may support pay-out at varying speeds thus supporting a reduction of interference between the conductors 310 along with a reduction of tangling or damage related to the interference between conductors 310.

It should be appreciated that the conductors may be paid-out of each of the respective multiple bays 120 separately or individually. For example, a first conductor may be paid-out of the independent bay 120A, and once the independent bay 120A is completely unspooled, a second conductor may be paid-out of the independent bay 120B. This process may be continued until the conductors are all paid-out of all, or a portion of, the independent bays 120A-120D.

At operation 520, the parallel conductor spool 100 is disposed in the field. Construction of the parallel conductor spool 100 of disposable or recyclable material such as wood, metal, cardboard or any combination thereof may allow disposal or recycling of the parallel conductor spool in the field. Field disposal or recycling of the parallel conductor spool 100 may support a reduction in transportation costs, management, and logistical complications associated with the returning of a spool or spooling system. The modular design of the bays 120 and outer flanges 110 of the parallel conductor spool 100 may be well suited for construction of disposable or recyclable materials.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A spooling system, comprising:

a reel comprising two end flanges fixed to and rotatable with a central hub disposed between and along a central axis of the two end flanges;

at least two rotatable bays disposed along the central hub between the two end flanges; and spacers disposed between the at least two rotatable bays.

2. The spooling system of claim 1, further comprising a rotation lock comprising:

voids disposed within at least one of the two end flanges of the reel and within the at least two rotatable bays; and a locking bar for inserting through the voids.

3. The spooling system of claim 1, further comprising a rotation lock comprising;

notches disposed within an edge of each of the at least two rotatable bays and within an edge of each of the two end flanges; and a locking mechanism for attaching to each of the notches to fix the at least two rotatable bays to one another and to the two end flanges.

4. The spooling system of claim 1, further comprising:

a pallet platform for supporting the reel; and a reel clamp for fixing the reel to the pallet platform.

5. The spooling system of claim 4, further comprising a fork-lift provision within the pallet platform.

6. The spooling system of claim 1, wherein the spacers are rings positioned over the central hub of the reel and between each of the at least two rotatable bays.

7. The spooling system of claim 1, wherein the at least two rotatable bays are configured to spool conductors for parallel dispensing at varying rates.

8. The spooling system of claim 1, wherein each of the at least two rotatable bays comprise two flanges fixed to a hub disposed between and along a central axis of the two flanges, the hub of each of the at least two rotatable bays disposed over the central hub of the reel.

9. A method for spooling, comprising:

providing a reel comprising two end flanges fixed to and rotatable with a central hub disposed between and along a central axis of the two end flanges;

positioning multiple independently rotating bays over the central hub and between the two end flanges of the reel;

inserting a locking bar through at least one of the two end flanges of the reel and the multiple independently rotating bays to lock the multiple independently rotating bays to temporarily prevent independent rotation of the multiple independently rotating bays; and after inserting the locking bar, rotating the two end flanges and the central hub of the reel to rotate the multiple independently rotating bays to take-up conductors onto at least one of the multiple independently rotating bays.

10. The method of claim 9, further comprising:

separately rotating an additional independently rotating bay to take-up an additional conductor; and after rotating the additional independently rotating bay to take-up the additional conductor, adding the additional independently rotating bay to the reel by positioning the additional independently rotating bay over the central hub and between the two end flanges of the reel.

11. The method of claim 9, further comprising positioning spacers between each of the multiple independently rotating bays.

12. The method of claim 9, further comprising attaching the reel with the multiple independently rotating bays to a pallet platform.

13. The method of claim 9, further comprising paying-out the conductors in parallel from the reel with the multiple independently rotating bays at differing rates.

14. The method of claim 9, wherein rotating the two end flanges and the central hub of the reel comprises mounting the reel with the multiple independently rotating bays within a take-up system comprising a rotating element that engages and rotates the parallel conductor spool.

15. A parallel conductor spool, the parallel conductor spool comprising:

a reel comprising two end flanges fixed to and rotatable with a central hub disposed between and along a central axis of the two end flanges; and at least two rotatable bays, each of the at least two rotatable bays comprising two flanges fixed to a hub disposed between and along a central axis of the two flanges, wherein the hub of each of the at least two rotatable bays is disposed over the central hub of the reel.

16. The parallel conductor spool of claim 15, further comprising a rotation lock comprising:

voids disposed within at least one of the two end flanges of the reel and within the at least two rotatable bays; and a locking bar for inserting through the voids.

17. The parallel conductor spool of claim 15, wherein the parallel conductor spool is configured to attach to a pallet platform.

18. The parallel conductor spool of claim 15, further comprising spacers disposed between the at least two rotatable bays, the spacers comprising rings positioned over the central hub of the reel and between each of the at least two rotatable bays.

19. The parallel conductor spool of claim 15, wherein the at least two rotatable bays spool conductors for parallel dispensing at varying rates.

20. The parallel conductor spool of claim 15, wherein the parallel conductor spool comprises disposable materials.

* * * * *